US006595198B2

(12) United States Patent
Mosher et al.

(10) Patent No.: US 6,595,198 B2
(45) Date of Patent: Jul. 22, 2003

(54) MULTI-PURPOSE COLLAPSIBLE PORTABLE STOVE

(75) Inventors: Robert Mosher, Wichita, KS (US); Darrell Neugebauer, Wichita, KS (US); David Linnebur, Derby, KS (US); Justin Radford, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/902,199

(22) Filed: Jul. 10, 2001

(65) Prior Publication Data

US 2003/0010332 A1 Jan. 16, 2003

(51) Int. Cl.[7] ..... F24C 5/20

(52) U.S. Cl. ..... 126/38; 126/39 R; 126/41 R; 126/304 A; 126/305; 431/284; 431/354

(58) Field of Search ..... 126/9 R, 25 R, 126/25 A, 41 R, 40, 50, 304 R, 304 A, 305, 39 R, 38; 431/284, 354, 285, 278; 248/150, 151, 250, 224.8

(56) References Cited

U.S. PATENT DOCUMENTS 744,901 A * 11/1903 Butterworth ..... 126/25 A
1,130,760 A * 3/1915 Paffrath ..... 126/30
2,852,016 A * 9/1958 Weatherwax ..... 126/38
5,342,192 A * 8/1994 Hirano ..... 431/284
5,765,469 A 6/1998 Schlosser et al. ..... 99/337
5,979,431 A * 11/1999 Hamilton et al. ..... 126/304 A

* cited by examiner

*Primary Examiner*—James C. Yeung
(74) *Attorney, Agent, or Firm*—Leydig, Voit & Mayer, Ltd.

(57) ABSTRACT

A collapsible portable stove may include a chassis, side tables, a shelf assembly, leg assemblies, a fuel delivery system, a burner system, a windscreen assembly, and a hoist assembly. The side tables may slide outward to reveal the burner system and provide workspace. The shelf assembly may attach to an underside of the chassis for storage, to a topside of the chassis between the outward-slid side tables for table space, or beneath the chassis between the leg assemblies for shelf space. The leg assemblies may fold for storage and unfold to raise the stove to a low- or high-profile. In a collapsed position, the stove and its self-contained components resemble a rectangular suitcase. The stove may be expanded from the collapsed position to several possible configurations, optionally having high- or low-profiles, exposed and/or covered burners, side tables, a hoist assembly, and a middle shelf or a middle table.

37 Claims, 11 Drawing Sheets

MULTI-PURPOSE COLLAPSIBLE PORTABLE STOVE

FIELD OF THE INVENTION

The present invention relates to portable stoves, and more specifically to a multi-purpose collapsible portable stove having, for example, a hoist assembly from which to raise and lower food for cooking, a burner-in-burner assembly, and a table configuration.

BACKGROUND INFORMATION

Portable stoves are popular cooking appliances, especially for use while camping or picnicking. Portable stoves commonly are powered by combustible gases, such as propane gas. A typical portable stove includes a stove frame, one or more burner assemblies arranged in the frame, and a gas supply coupled to the burner assembly via a control valve. Smaller versions convenient for backpacking may be not much larger than the gas canister itself, while larger versions designed for group camping may be the size of a large briefcase. The larger portable stoves typically are designed to rest on a picnic table and open and close in a manner similar to that of a hard-sided suitcase. As with a suitcase, there may be a handle in the middle of the long, narrow front panel for carrying the portable stove in the closed position.

While these larger, suitcase-style portable stoves work well for heating small to medium-sized pans and skillets, they are of limited use. Generally, they require a separate table on which to rest, they have a limited range of heating (either a low range or a high range), they do not provide shelf space on which to rest items, and they often cannot accommodate cooking large items, such as a turkey. It would be advantageous to have a portable stove which has collapsible legs permitting it to stand alone. It would also be advantageous to be able to configure the portable stove as either a stove or as a table, with the option of a self-contained shelf, depending on the needs of the user. The user may also desire to cook larger dishes, such as a turkey, so it would be useful to have a stable construction supporting a hoist assembly from which to hang larger items for cooking, such as by deep-frying. While it would be preferable that the stove be powerful enough to heat large items, it nonetheless would also be desirable that the stove have a low minimum power output for heating small pans without overheating them.

SUMMARY OF THE INVENTION

The present invention provides a collapsible portable stove including a chassis, side tables, a shelf assembly, leg assemblies, a fuel delivery system, a burner system, a windscreen assembly, and a hoist assembly. A fuel supply, such as a propane gas canister, attaches to the fuel delivery system to supply gas for combustion. In a collapsed position, the stove and its components fold together to resemble a rectangular suitcase, the components being self-contained therein. The stove may be expanded from the collapsed position to several configurations, including high- and low-profile exposed-burner stove configurations having side tables, an optional hoist assembly and an optional middle shelf, and high- and low-profile covered-burner table configurations, optionally having side tables and a middle shelf, and high- and low-profile stove/table combination configurations having a side table, an optional hoist assembly and an optional middle shelf

BRIEF DESCRIPTION OF THE DRAWINGS

FIG. 3A depicts a bottom perspective view of an arm of a shelf assembly in an outward position, whereas

FIG. 10A is a cross-sectional view of the control panel near a valve assembly and a knob, whereas

FIG. 12A is a sectional perspective view of an exemplary pole holder in which an exemplary hoist assembly is inserted, while

DETAILED DESCRIPTION

High-Profile Exposed-Burner Stove Configuration A

Figure 1:
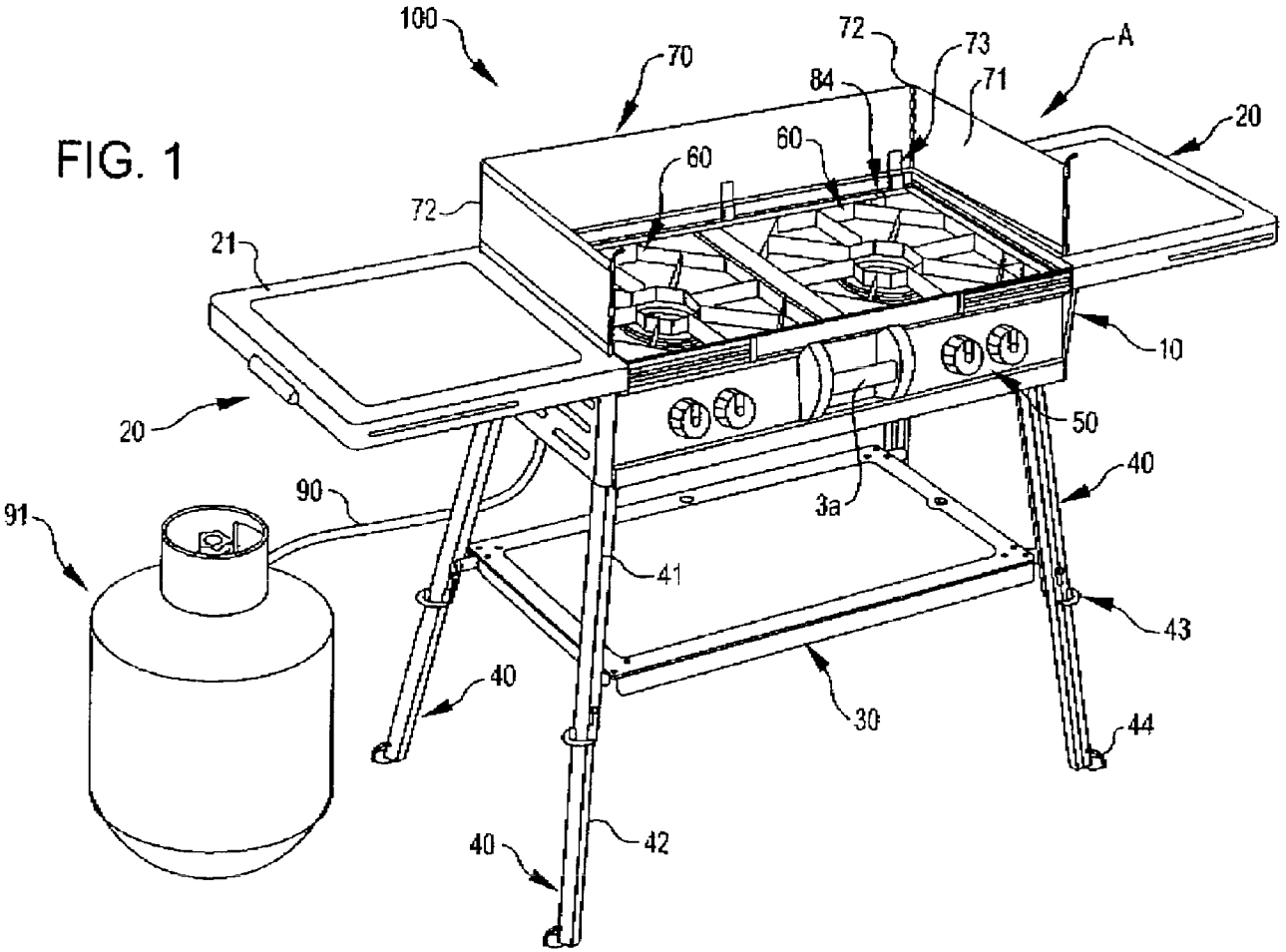
FIG. 1 shows a perspective view of a collapsible portable stove according to an exemplary embodiment of the present invention in an exemplary high-profile exposed-burner stove configuration.
Figure 8:
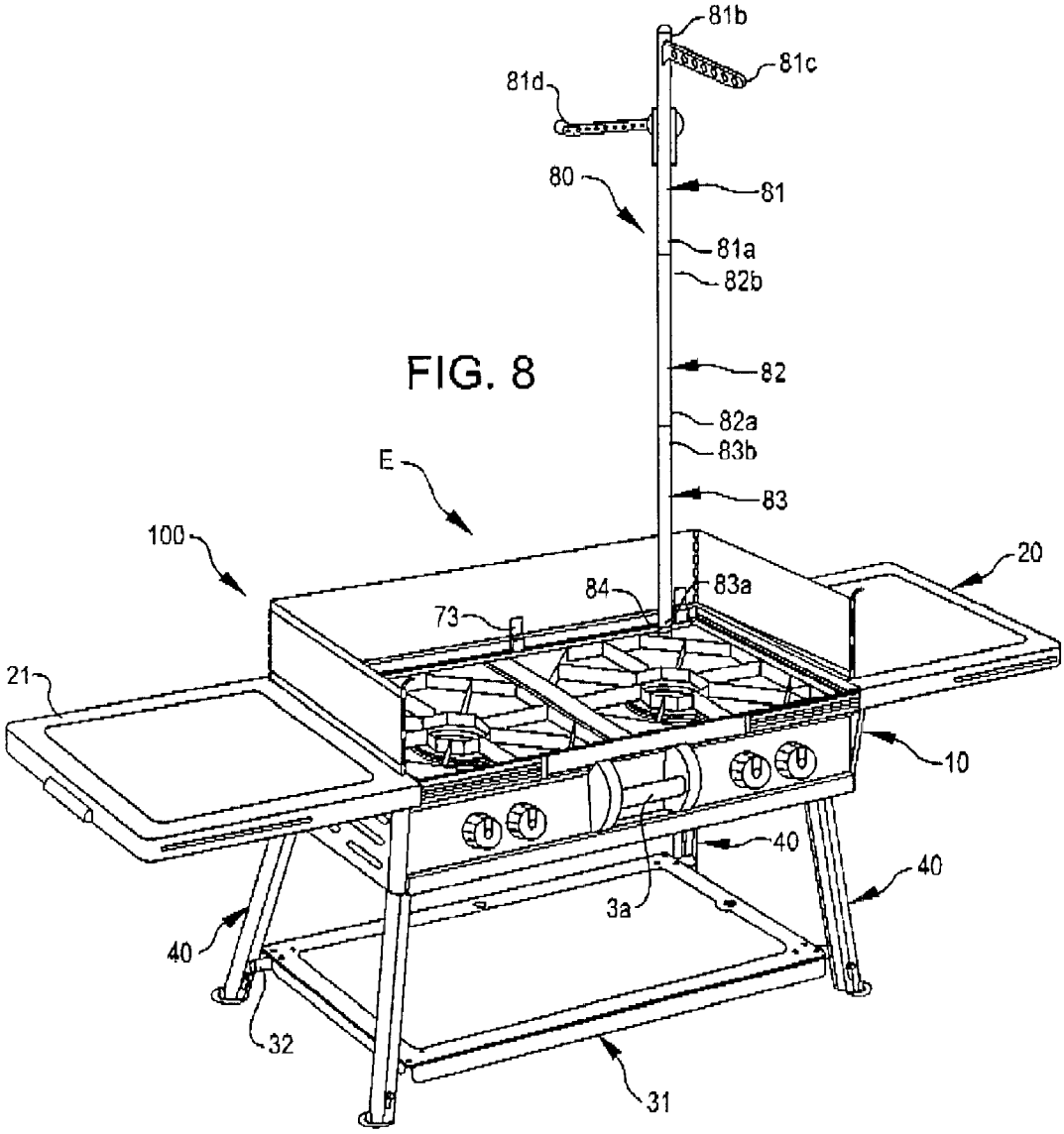
FIG. 8 is a perspective view of the stove of FIG. 1 in an exemplary low-profile exposed-burner stove configuration and fitted with a hoist assembly.

Referring to the figures, FIG. 1 shows a perspective view of a collapsible portable stove 100 according to an exemplary embodiment of the present invention in an exemplary high-profile exposed-burner stove configuration "A." As shown in FIG. 1, a collapsible portable stove 100 may include a chassis 10, side table assemblies 20, a shelf assembly 30, leg assemblies 40, a fuel delivery system 50, a burner system 60, a windscreen assembly 70, and a hoist assembly 80 (see FIG. 8). A fuel supply 90, such as a propane gas canister 91, separately may attach to the fuel delivery system 50 to supply gas for combustion. Configuration A is considered to have a high-profile insofar as the leg assemblies 40 are fully extended. FIG. 1 depicts both the side tables 20 in an extended position, the shelf assembly 30 in an attached shelf position, and the windscreen assembly 70 in an upright position.

The Chassis

Figure 4:
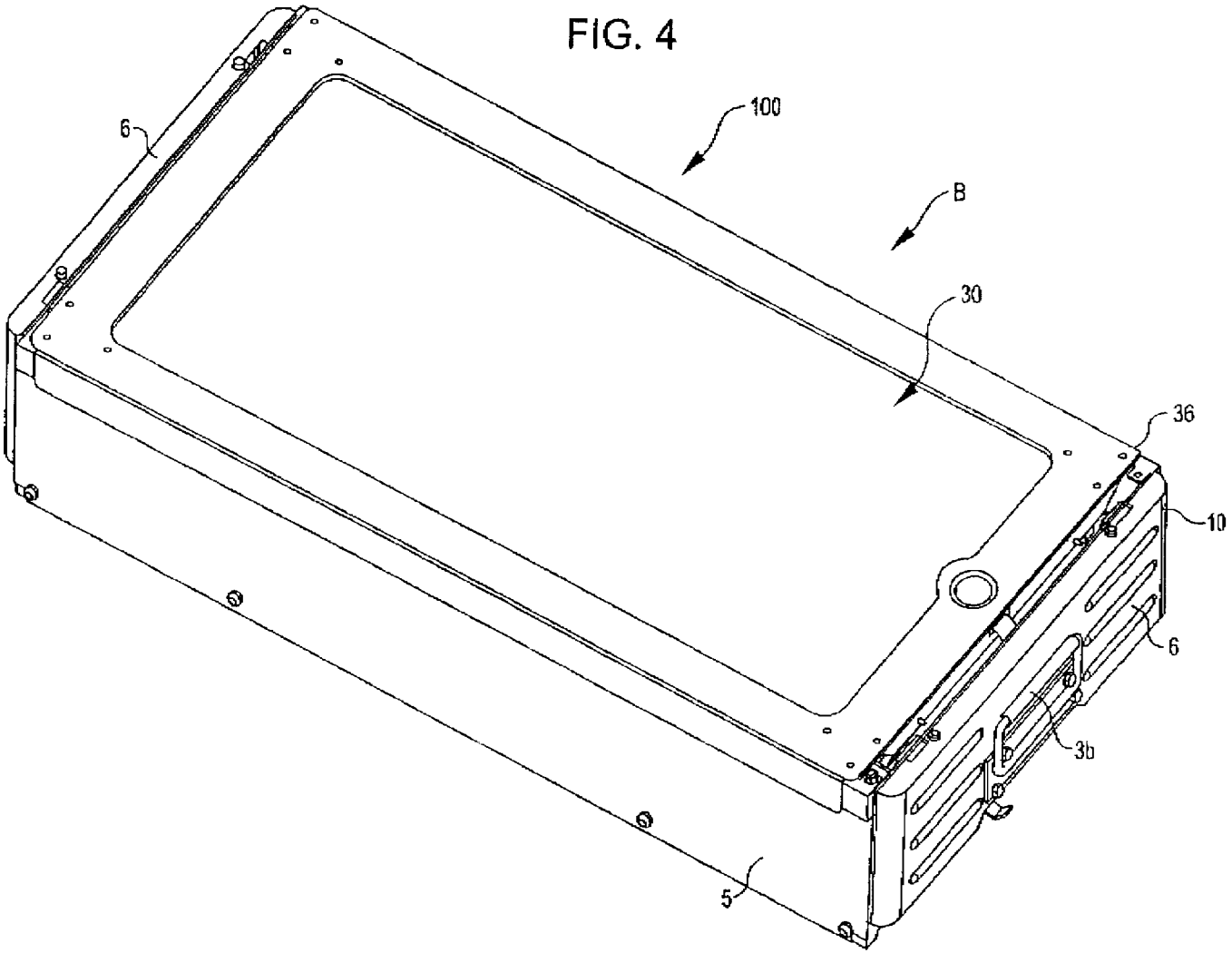
FIG. 4 depicts a perspective view of the stove of FIG. 1 upside-down in an exemplary collapsed configuration.

The chassis 10 may include a frame 1 (FIG. 5), heat shields 2*a* and 2*b* (FIG. 10B), handle assemblies 3*a* (FIG. 1) and 3*b* (FIG. 5), a control panel 4 (FIG. 6), a back cover 5 (FIG. 4), and end covers 6 (FIG. 4). Two side handle assemblies 3*a* may be used to carry the stove 100 like a tray, whereas front handle assembly 3*b* may be used to carry the stove 100 like a suitcase. The frame 1 may provide structural support for all of the components of the stove 100 and cooking vessels. The heat shields 2*a* and 2*b* may attach to the frame 1 with, for example, screws (or other such attachment means) and provide thermal protection to valve assemblies 51 (FIG. 10B) and to a regulator hose assembly 52 (FIG. 10A) of the fuel delivery system 50. Heat shield 2*a* may protect the fuel delivery system 50 in general, while heat shield 2*b* may protect mainly the control panel 4. The control panel 4, back cover 5, and end covers 6 may attach to the frame 1 with, for example, screws and define an external appearance of the stove 100.

It is understood that the use of all specific attachment means mentioned herein, such as screws to attach components, is exemplary of an appropriate attachment means and does not limit the present invention to using the specific attachment means to accomplish the intended purpose, e.g., using screws to attach components. Other acceptable attachment means will be evident to one of ordinary skill in the art. For example, rivets, nails, nuts and bolts, snap-lock spikes, welding, crimping, and adhesives may be appropriate attachment means, depending on the situation and the intended purpose.

The Side Tables Assemblies

Figure 2:
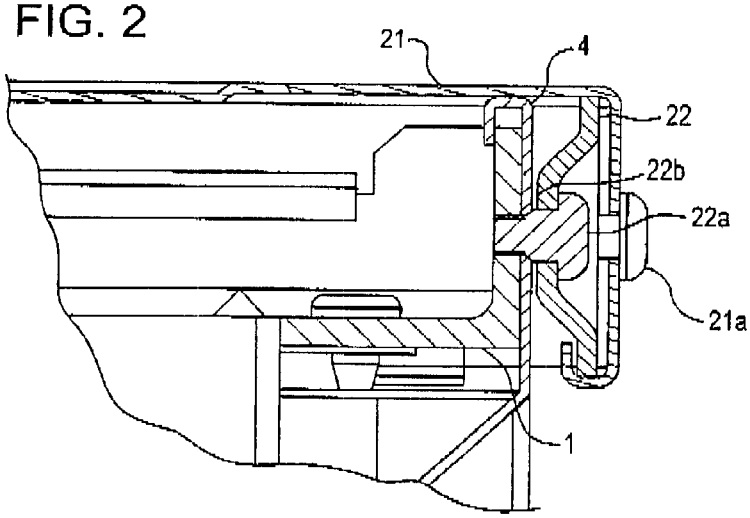
FIG. 2 shows a cross-sectional view of an exemplary side table assembly attached to a frame.

The side table assemblies 20 may include side tables 21 and slides 22 (FIG. 2). FIG. 2 shows a partial cross-section of an exemplary side table assembly 20 attached to the frame 1. The slide 22 may be attached to the frame 1 using a shoulder screw 22*a* and possibly having a washer 22*b*, such as a brass washer, between the slide 22 and the frame 1. In contrast to prior art shelves that unfold open or are separate from the stove and require secondary support means, the side tables 20 slide open to the extended position, using the slides 22 for support. Although the figures show exemplary embodiments of the stove 100 as having two side table assemblies 20 to cover two burner systems 60, the stove 100 may be constructed with only one side table assembly 20. As shown in FIG. 2, the side tables 21 may attach to the slides 22 with screws 21*a*, for example, in such a way as to allow the side tables 21 to slide along the frame 1 over a topside 23 (FIG. 7) of the frame 1, thereby covering the burner systems 60 of the stove 100.

The Shelf Assembly

Figure 3A:
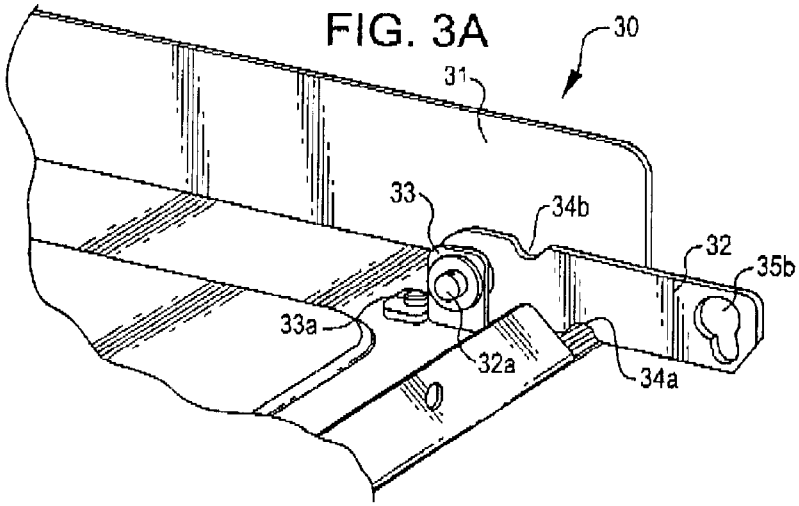
Figure 3B:
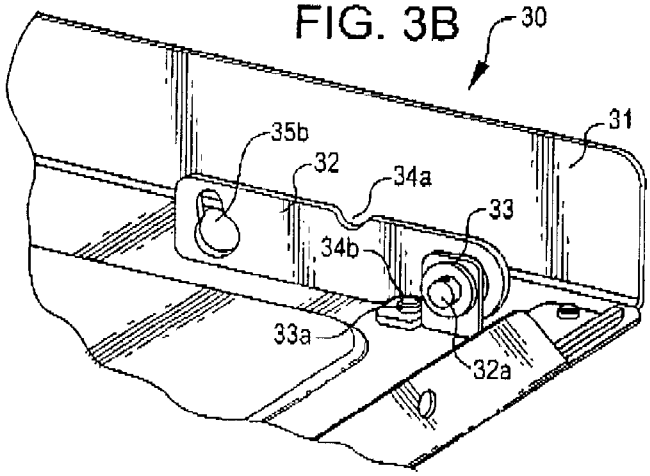
FIG. 3B depicts the arm in an inward position.

Referring to FIG. 3A and FIG. 3B, the shelf assembly 30 may include a middle shelf 31, arms 32, and arm brackets 33. The arms 32 may be attached to the arm brackets 33 with, for example, clevis pins 32*a* and washers, allowing the arms 32 to pivot. The arm brackets 33 may be attached to the middle shelf 31 with, for example, rivets 33*a*. FIG. 3A depicts the arm 32 of the shelf assembly 30 in an outward position, whereas FIG. 3B depicts the arm 32 in an inward position. The arms 32 may have grooves 34*a* and 34*b* so as to lie flat when in either the inward or the outward position. The shelf assembly 30 may be suspended in a substantially horizontal position from pegs 35*a* (FIG. 9C) on the leg assemblies 40 using peg holes 35*b* on the arms 32. In this position, the shelf assembly 30 may be used, for example, to store cooking items. Alternatively, the shelf assembly 30 may be secured to an underside 36 of the frame 1, in an attached underside position as shown in FIG. 4, to cover the underside 36 of the frame 1, either to stow the shelf assembly 30 while the stove 100 is in a modified configuration A, or to enclose the leg assemblies 40 while the leg assemblies 40 are stowed, such as in FIG. 4.

Collapsed Stove Configuration B

Figure 5:
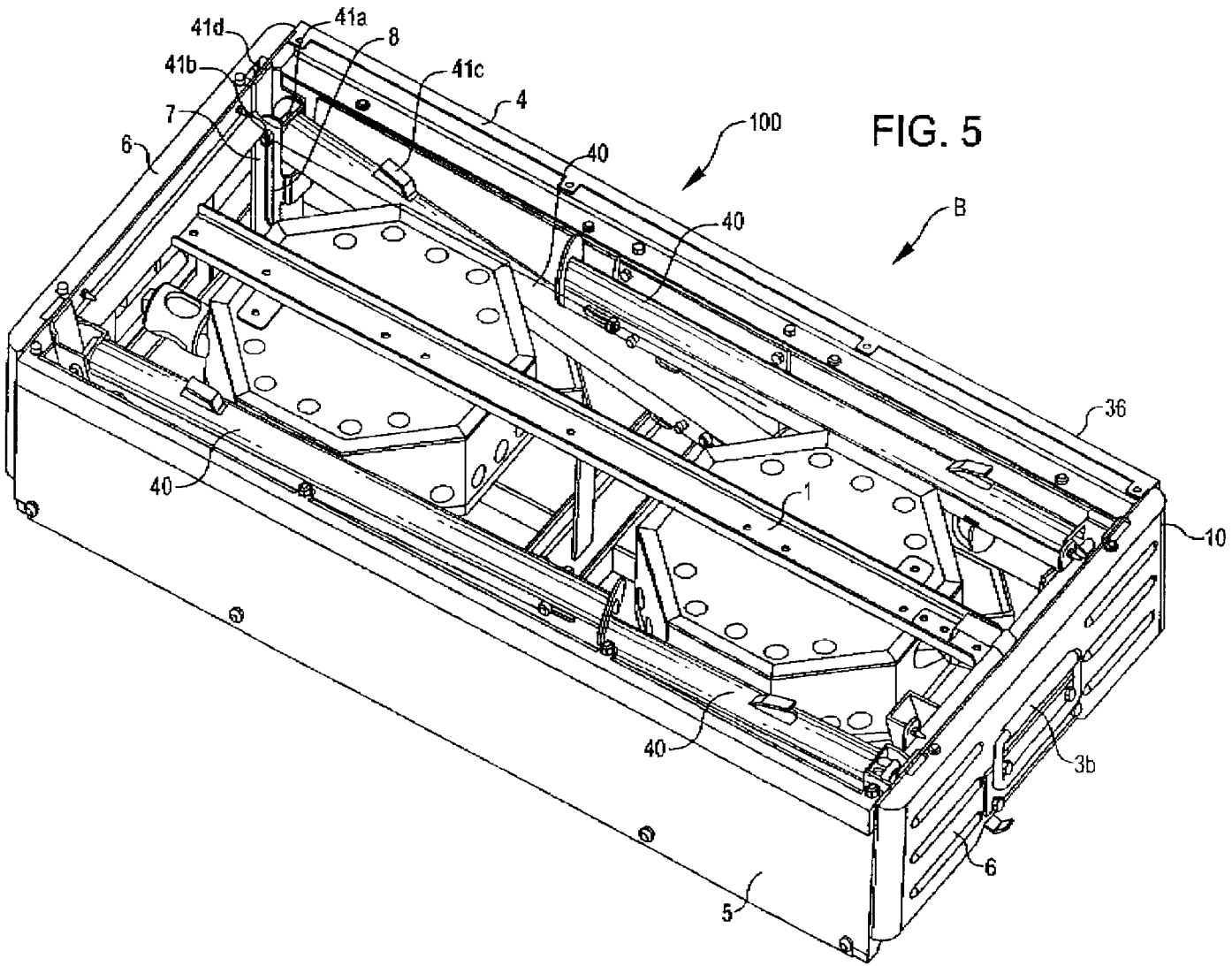
FIG. 5 shows a perspective view of the stove of FIG. 4 without the shelf assembly covering the underside.

FIG. 4 depicts a perspective view of the stove 100 upside-down in an exemplary collapsed configuration B. Configuration B depicts the stove 100 and its components folded together to resemble a rectangular suitcase, the components being self-contained therein. The shelf assembly 30 is attached to the chassis 10 in the attached underside position. By comparison, FIG. 5 also shows a perspective view of the stove 100 in configuration B, but without the shelf assembly 30 covering the underside 36, thereby exposing the folded leg assemblies 40 stowed within the frame 1. However, FIGS. 4 and 5 show the stove 100 with the side tables 20 removed, as explained in relation to FIG. 7. The stove 100 may be expanded from the collapsed configuration B to several configurations, including configuration A, described above, and configurations C–E, shown in FIGS. 6–8 and described below.

High-Profile Covered-Burner Table Configuration C

Figure 6:
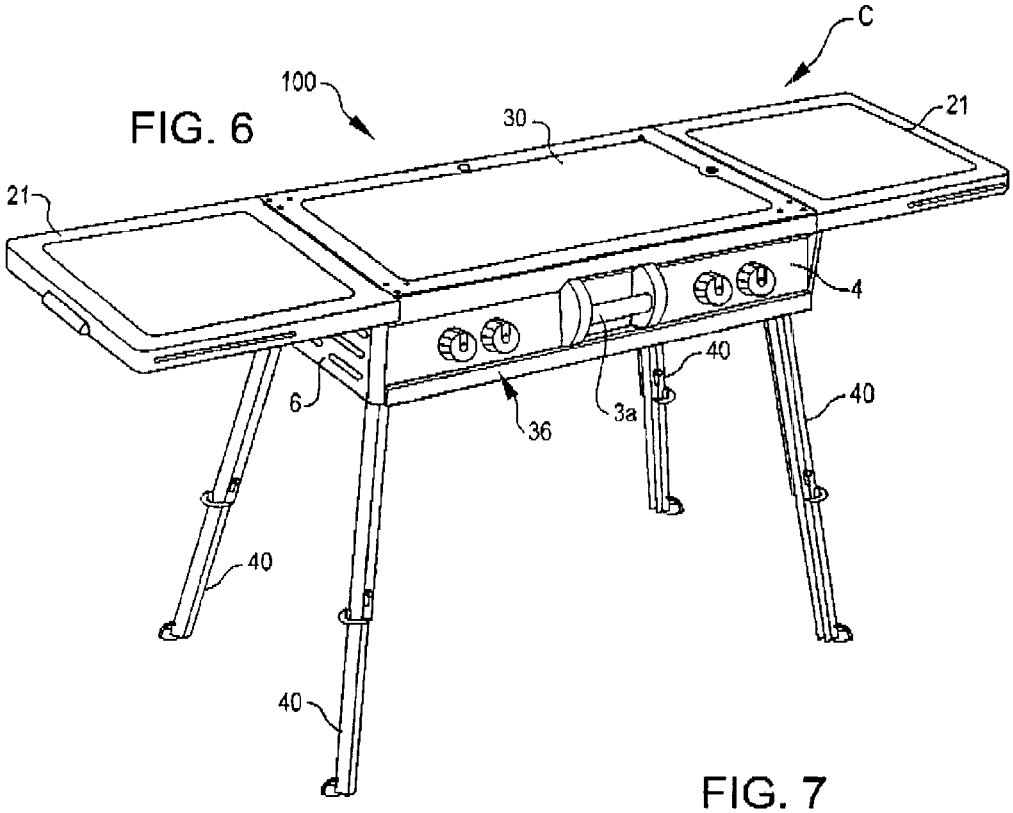
FIG. 6 depicts a perspective view of the stove of FIG. 1 in an exemplary high-profile covered-burner table configuration with the shelves extended.

If the side tables 21 are slid to their extended positions, the shelf assembly 30 may be arranged on the topside 23 of the frame 1 between the side tables 21 to cover the burner systems 60 and form a large table, as shown in FIG. 6. FIG. 6 depicts a perspective view of the stove 100 in a configuration C. Configuration C is characterized as a high-profile covered-burner table configuration having side tables 20 in the extended position and the shelf assembly 30 attached to the topside 23. Alternatively, the side table assemblies 20 may be replaced entirely with a second shelf assembly 30 (FIG. 6) that may be stowed beneath the chassis 10 while the first shelf assembly 30 is in the attached shelf position.

High-Profile Stove/Table Combination Configuration D

Figure 7:
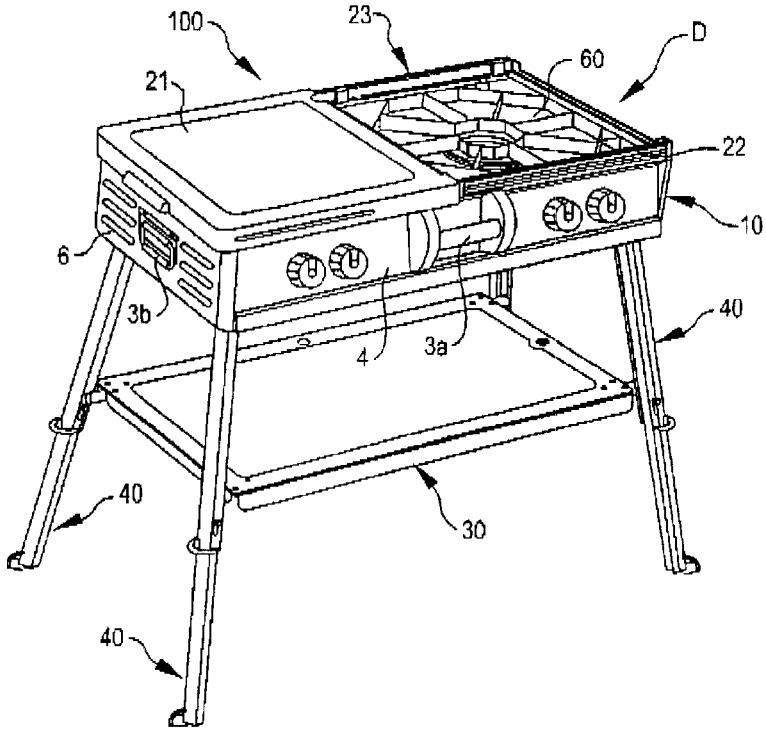
FIG. 7 shows a perspective view of the stove of FIG. 1 in an exemplary high-profile stove/table combination configuration with a right shelf removed and a left shelf retracted.

FIG. 7 shows a perspective view of the stove 100 in a configuration D characterized as a high-profile stove/table combination configuration having a side table 21 in a retracted position and the shelf assembly 30 in the attached shelf position. In FIG. 7, the left side table 21 covers the left burner system 60, forming a small table space adjacent the right burner system 60, which is exposed by the removal of the right side table 21. Typically, the right side table 21 would be slid to the right in the extended position when the stove 100 is in configuration D, but the side tables 21 may be made to releasably engage the slides 22 to permit the side tables 21 to be removed easily. Removal of the side tables 21 may be advantageous if the stove 100 is to be operated in a confined space not large enough to accommodate the length of the stove 100 with the side tables 21 in the extended position.

Low-Profile Exposed-Burner Stove Configuration E

To further illustrate the versatility of the stove 100, FIG. 8 is a perspective view of the stove 100 in an exemplary low-profile exposed-burner stove configuration E having side tables 21 in the extended position, the hoist assembly 80 in an inserted position, and the shelf assembly 30 in the attached shelf position. The stove 100 preferably is placed in the low-profile configuration E for added stability while using the hoist assembly 80, lessening the possibility that the stove 100 would tip over during use if bumped or if the weight thereon were to become unbalanced. The hoist assembly 80 may provide the user with increased control over and access to larger items, including tall pots, that might otherwise require the use of both hands. Use of the hoist assembly 80 also may permit the user to distance himself from the heat of the stove 100 while adjusting the items while cooking.

The Leg Assemblies

Figure 9A:
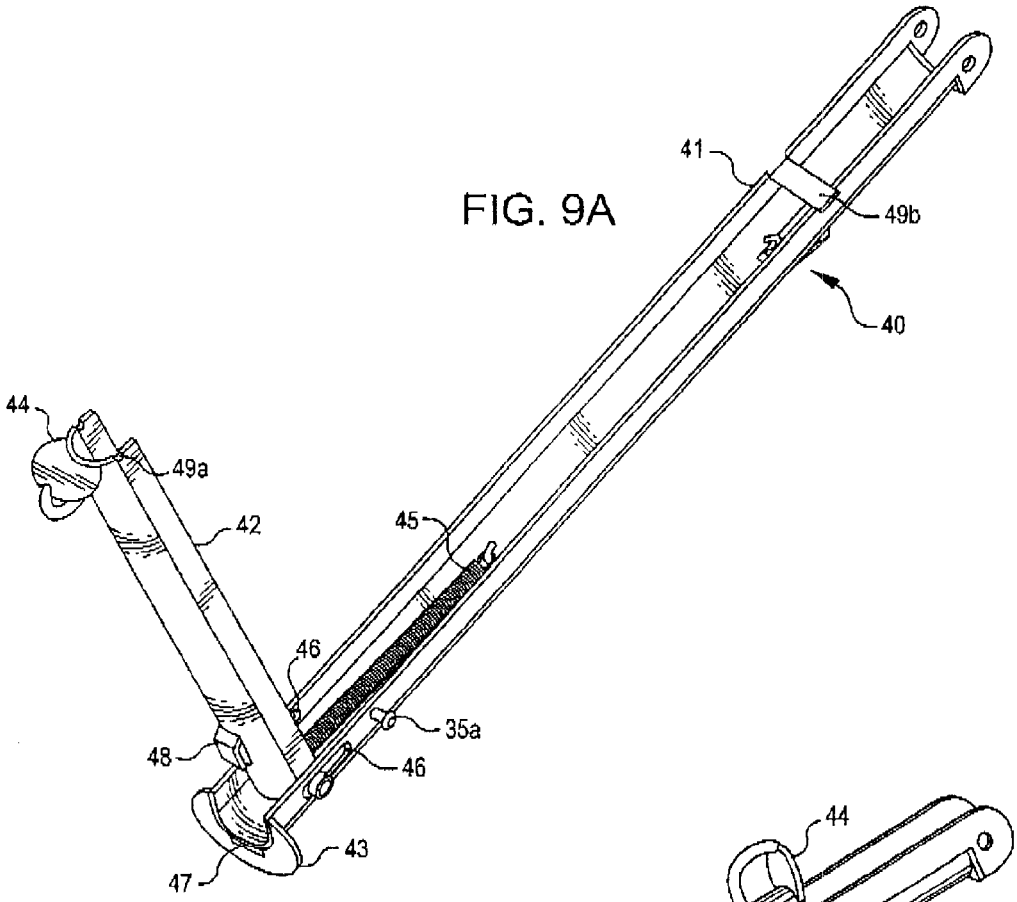
FIG. 9A shows a perspective view of an exemplary leg assembly having an exemplary lower leg partially deployed from an exemplary upper leg.

As shown in FIGS. 9A–9D, each of the leg assemblies 40 may include an upper leg 41 and a lower leg 42. Unlike leg assemblies having telescopic-leg mechanisms, the leg assembly 40 may have a folding-leg mechanism. The combination of the four leg assemblies 40 may be characterized generally as an elevation system, and although the figures depict exemplary embodiments of the stove 100 as having four leg assemblies 40, other exemplary embodiments may include as few as three leg assemblies, arranged triangularly, or more than four leg assemblies 40 for additional support. FIG. 9A shows an exemplary lower leg 42 partially deployed from an exemplary upper leg 41. The upper leg 41 and the lower leg 42 may be shaped, for example, as half-pipes, i.e., having a U-shaped cross-section, or other feasibly sturdy construction. The lower leg 42 may be attached to the upper leg 41 with, for example, a bolt 42*a* and a nut 42*b*, or other appropriate means, so as to permit the lower leg 42 to rotate 180 degrees to fold into the upper leg 42.

The lower leg 42 may lock into the upper leg 41 when fully deployed, and the locking mechanism may include, for example, a spring 45, a cam slide slot 46, a tooth groove 47 and a tooth 48. To engage the tooth 48 in the tooth groove 47, the lower leg 42 must be fully deployed and slid on the bolt 42*a* along the cam slide slot 46 away from the spring 45. However, the spring 45 exerts force on the lower leg 42 towards the upper leg 41, pulling the lower leg 41 upward along the cam slide 46 and wedging the tooth 48 into the tooth groove 47, thereby creating a stable engagement. The cam slide slot 46 may slope downwardly into the U-shaped upper leg 41 toward the spring 45 so as to securely wedge the top of the lower leg 42 into the trough of the U-shaped channel on the lower end of the upper leg 41.

Figure 9B:
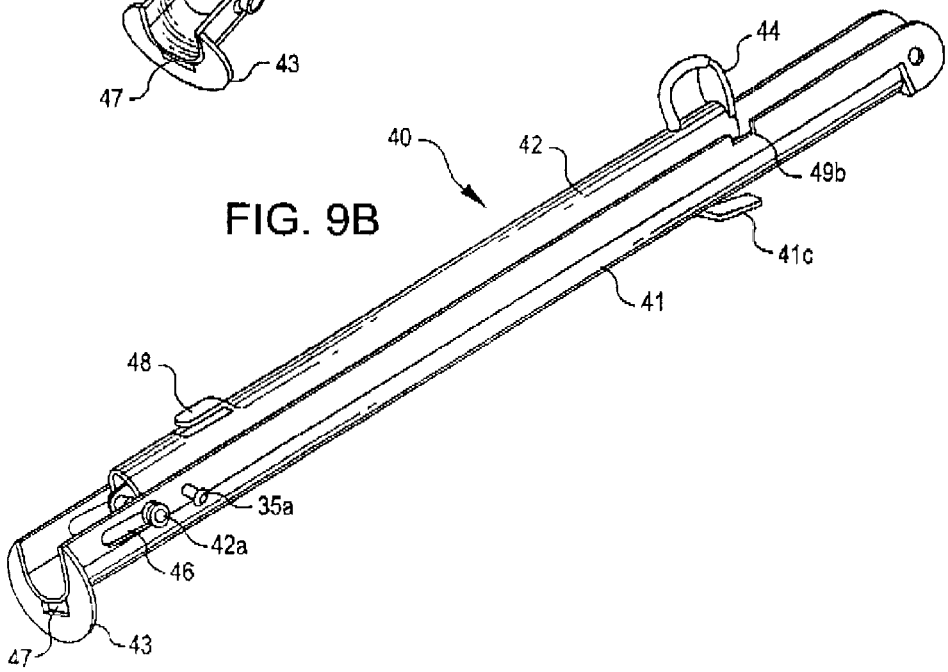
FIG. 9B shows a perspective view of the lower leg folded into the upper leg.

FIG. 9B shows a perspective view of the lower leg 42 folded into the upper leg 41. The upper leg 41 may be slightly wider in diameter than the lower leg 42 so as to allow the lower leg 42 to fit inside the upper leg 41. The spring 45 also may lock the lower leg 42 in place against the upper leg 41 in the folded position by exerting force on the lower leg 42 so as to cause a detent groove 49*a* on the lower leg 42 to engage a detent bar 49*b* on the upper leg 41. Similarly, the upper leg 41 may be attached to a leg holder 7 on the frame 1 with, for example, a bolt 41*a* and a nut 41*b* (see FIG. 5) along a cam slide slot 8 in such a way as to allow the leg assembly 40 to rotate up into the stove 100 for storage. The upper leg 41 may slide along cam slide slot 8 and have a tooth 41*c* (FIG. 5) that engages a tooth detent 41*d* to brace the leg assembly 40. The leg assemblies 40 may be angled outward slightly beyond each corner of the chassis 10 so as to create a pyramidal appearance, adding stability both front to back and side to side.

Figure 9C:
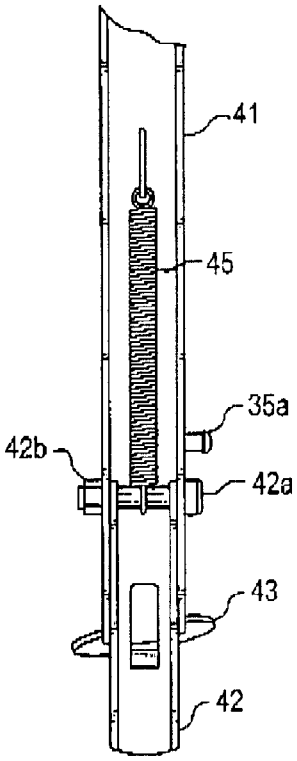
FIG. 9C shows a sectional back elevational view of the leg assembly fully deployed.
Figure 9D:
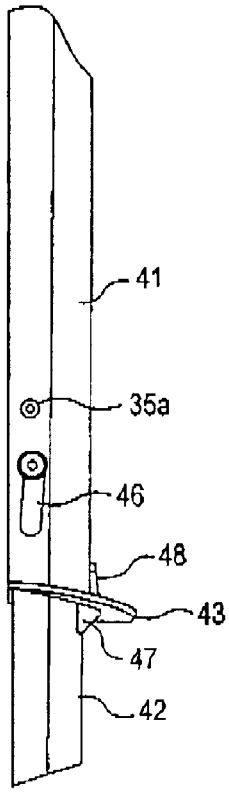
FIG. 9D shows a sectional side elevational view of the leg assembly fully deployed.

Moreover, the upper leg 41 may include an angled annular support 43 (FIG. 9A) to improve stability of the leg assembly 40 when the stove 100 is standing only on the upper legs 41. FIG. 9C shows a partial back elevational view of the leg assembly fully deployed; and FIG. 9D shows a partial side elevational view of the leg assembly fully deployed. The stove 100 may be considered to be in a low-profile configuration when the stove 100 is standing only on the upper legs 41, such as in FIG. 8. Likewise, the lower leg 42 may include an angled crescent support 44 capable of folding into the upper leg 41 to better distribute the weight of the stove 100 in a high-profile configuration. Allowing the stove 100 to be used with just the upper legs 41 folded out permits a low-profile, stable configuration, such as shown in FIG. 8, suitable for heating large, heavy cooking vessels. By unfolding the lower legs 42, the cooking level of the stove 100 may be raised to a high-profile, standard working height suitable for general-purpose cooking.

The Fuel Delivery System

Figure 10A:
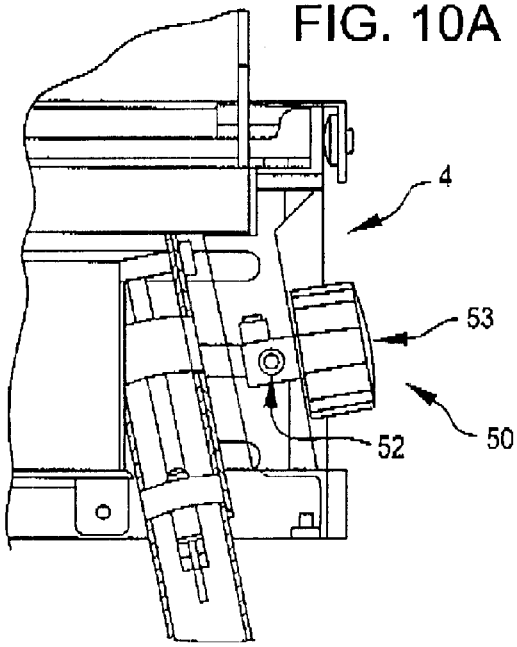
Figure 10B:
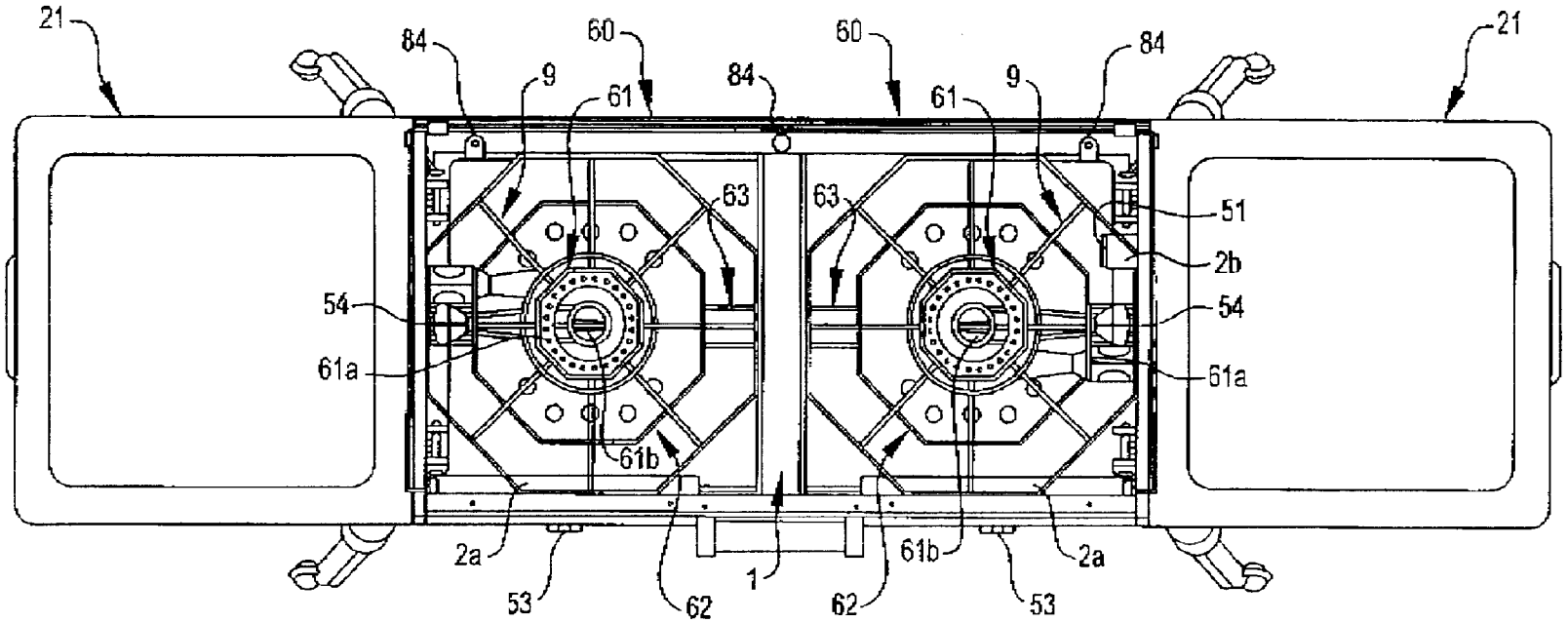
FIG. 10B is a top plan view of an exemplary stove in an exemplary high-profile exposed-burner stove configuration.

Referring to FIGS. 10A and 10B, the fuel delivery system 50 may include a regulator hose assembly 51 (not visible because covered by the heat shield 2*b*), valve assembly 52, knobs 53, and gas tip assemblies 54. FIG. 10A is a cross-sectional view of the control panel 4 near a valve assembly 52 and a knob 53. Inasmuch as the fuel delivery system 50 largely is concealed by other components within the chassis 10 of the stove 100, only portions of it are visible in the figures. FIG. 10B is a top plan view of the stove 100 in an exemplary high-profile exposed-burner stove configuration, such as configuration A. The regulator hose assembly 51 may attach to an inlet end of the valve assembly 52 with, for example, a flare nut. The valve assembly 52 may attach to the frame 1 and control panel 4 with, for example, jam nuts. The knobs 53 may be secured to the valve assembly 52 with, for example, screws. The knobs 53 may control the flow of fuel through the valve assembly 52. The gas tip assemblies 54 may be attached to an outlet end of the valve assembly 52 and to an inlet of the burner system 60. Depending on the burner system 60 configuration, the stove 100 may be equipped with one knob 53 per burner system 60, as in FIG. 10B, or with two knobs 53 per burner system 60, as in FIGS. 1, and 6–8.

The Burner Systems

As shown in FIG. 10B, each of the burner systems 60 may include a burner 61, wind baffle 62, and a burner support 63. Although the figures show exemplary embodiments of the stove 100 as having two burner systems 60 and two side table assemblies 20, the stove 100 may be constructed with only one burner system 60, or with only one side table assembly 20. The burner 61 and wind baffle 62 may be attached to the burner support 63 with, for example, screws. Burner gratings 9 may be attached to the frame 1 for support and form a part of the chassis 10. The burner 61 may include two sub-burners, 61*a* and 61*b*, that may be configured such that a low power sub-burner 61*b* nests inside a high power sub-burner 61*a* forming a "burner-in-burner" system. Each sub-burner 61*a* and 61*b* may be controlled by a separate knob 53, having two knobs 53 per burner system 60, as mentioned above, or a single knob 53 may control both sub-burners 61*a* and 61*b*.

Figure 11A:
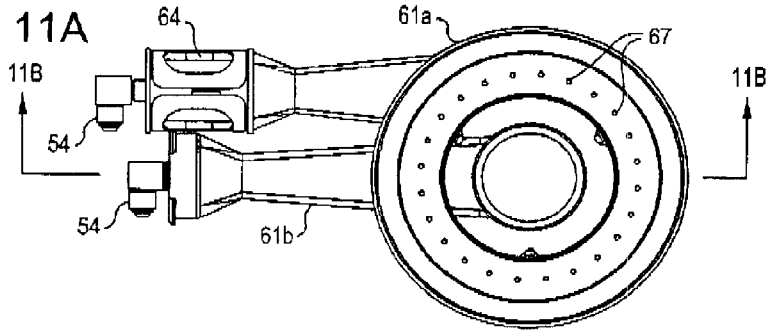
FIGS. 11A and 11B are a top plan view and a cross-sectional side elevational view, respectively, of an exemplary low power sub-burner nested within an exemplary high power sub-burner.
Figure 11B:
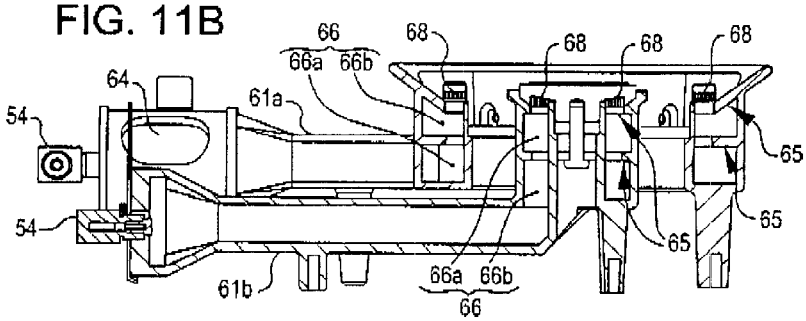

FIGS. 11A and 11B further illustrate exemplary sub-burners 61*a* and 61*b*. FIGS. 11A and 11B are a top plan view and a cross-sectional side elevational view, respectively, of an exemplary low power sub-burner 61*b* nested within an exemplary high power sub-burner 61*a*. In addition to incorporating, for example, a Venturi configuration 64, the high power sub-burner 61*a* may include internal baffles 65 to more evenly distribute the fuel circumferentially around an annular gas chamber 66 to burner holes 67 and burner combs 68. The internal baffles 65 may be useful in reducing the gas pressure near the entrance of the annular gas chamber 66, lessening the likelihood that the gas will flow unevenly out the burner holes 67 and possibly flare up near the entrance. The low power sub-burner 61*b* also may include internal baffles 65, which may be less predominant than those in the high power sub-burner 61*a*, due to the lower pressure at which gas flows to the low power sub-burner 61*b*. In effect, the internal baffles 65 may divide the annular gas chamber 66 between a lower annular gas chamber 66*a* and an upper annular gas chamber 66*b*. Similarly, the internal baffles 65 may be replaced with a perforated plenum (not shown) to separate the annular gas chamber 66 into a lower annular gas chamber 66*a* and an upper annular gas chamber 66*b*.

In distinction from former designs that enable either high heating ranges or low heating ranges, this burner-in-burner system may allow full adjustment of the fuel flow to facilitate an incremental heating range allowing low, medium and high heating. Typically, burners designed with enough BTU input to heat large cooking vessels effectively cannot be adjusted low enough for general purpose cooking. Moreover, at low heat settings, the high output burners are prone to being extinguished in the wind. However, the incremental heating range of the present invention effectively may provide between as little as 5% and as much as 100% of the total flow, with the total flow providing up to 100,000 BTU per hour, i.e., enough BTU input to heat large cooking vessels.

The Windscreen Assembly

As shown in FIGS. 1 and 8, the windscreen assembly 70 may include three sheets 71 attached to each other by two hinges 72. The windscreen assembly 70 may be removably secured to the frame 1 with, for example, clips 73. The windscreen assembly 70 may be detached from the frame 1 and folded for storage inside the stove 100 when the stove 100 is collapsed, as in FIG. 4.

The Hoist Assembly

Figure 12A:
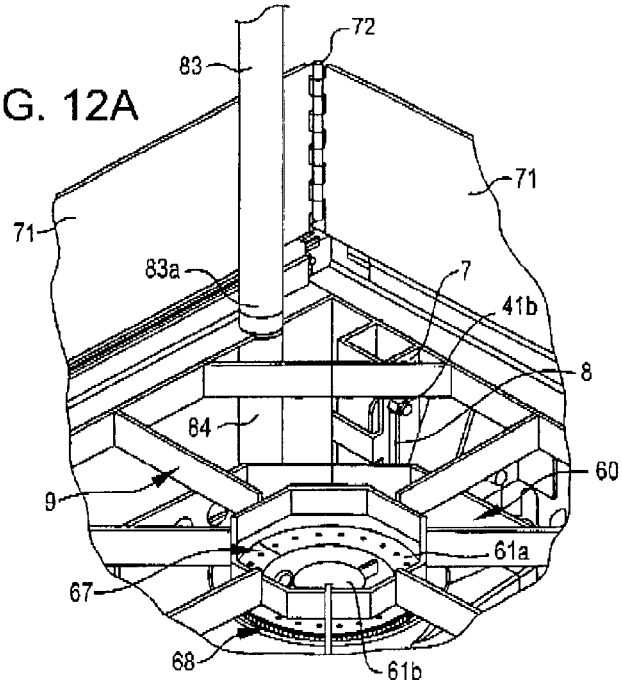

Referring to FIG. 8, the hoist assembly 80 may include a winch head 81, a pole extension 82, and a pole base 83. A proximate end 83*a* of the pole base 83 may be shaped to fit within a pole holder 84 attached to or integral with the frame 1. FIG. 12A is a sectional perspective view of an exemplary pole holder 84 in which an exemplary hoist assembly 80 is inserted. Although the pole holder 84 is shown in the right rear corner, it may be constructed at any corner of a burner system 60. A proximate end 82*a* of the pole extension 82 may fit within a recess in a distal end 83*b* of the pole base 83, and similarly, a proximate end 81*a* of the winch head 81 may fit within a distal end 82*b* of the pole extension 82.

Figure 12B:
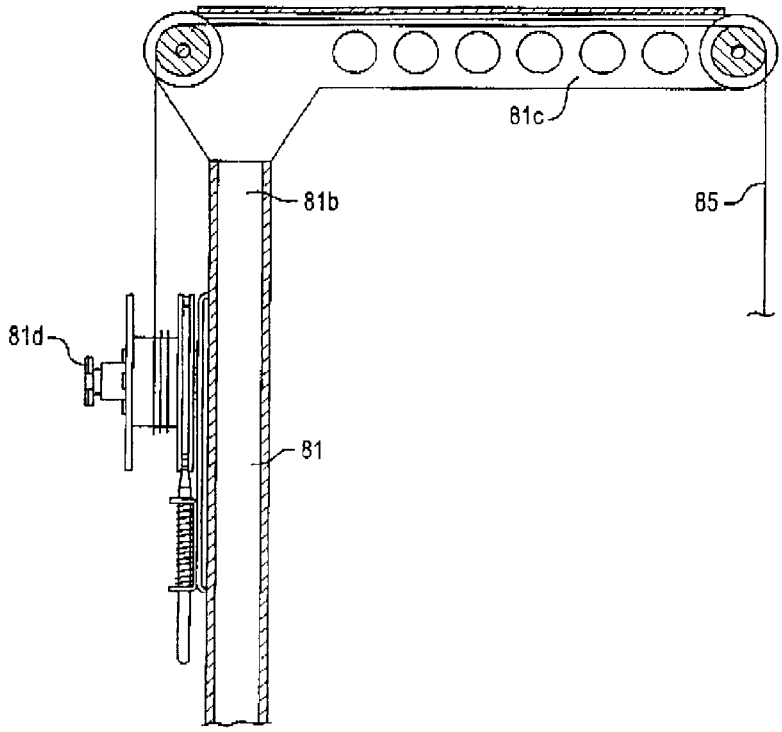
FIG. 12B is a sectional side elevational view of an exemplary winch head.

FIG. 12B is a sectional side elevational view of an exemplary winch head 81. At a distal end 81*b* of the winch head 81, an overhang 81*c* may place a winch wire 85 above a center of the burner system 60 located beneath the overhang 81*c*, thereby centering the item to be hung by the winch wire. A winch handle 81*d* may be used to coil and uncoil the winch wire 85, thereby raising and lowering the item hanging by the winch wire 85. An important advantage of the hoist assembly 80 is that it allows a person to slowly lower a heavy piece of food, like a turkey, into, for example, a vessel of hot oil without bearing the weight of the food with ones arms. The winch head 81 may operate as a conventional reversible ratchet system, providing incremental support for the load as a ratchet tooth (not shown) engages a series of ratchet cogs (not shown).

In particular, the previously used methods for placing large items, such as turkeys, into large vessels of boiling oil, for example, involved the user lowering the turkey by hand into the boiling oil. When the turkey, which commonly is still defrosting and thus partly frozen, contacts the boiling oil, the oil vaporizes the water or ice crystals, causing the oil to crackle and splatter. The splattering oil potentially may cause the user to jump backward and rapidly drop the turkey, resulting in even greater displacement of the boiling oil as much of the water or ice quickly evaporates, creating a potentially explosive situation with water vapor quickly increasing the pressure in the turkey and the vessel. However, by using the hoist assembly 80, the user may lower the turkey more slowly, resulting in less splattering, and from a distance, decreasing the likelihood that oil may splatter on the user. If the user steps back, the winch head 81 holds the turkey in place and prevents it from dropping farther.

A number of embodiments of the present invention have been described above. Nevertheless, it will be understood that various modifications may be made without departing from the spirit and scope of the invention. Accordingly, other embodiments may be within the scope of the following claims. It is intended that all matter contained in the above description or shown in the accompanying drawings shall be interpreted as illustrative and not in a limiting sense. It is also understood that the following claims are intended to cover all of the generic and specific features of the invention herein described and all statements of the scope of the invention, expressed or implied.

What is claimed is:

1. A collapsible portable stove comprising:

a chassis, a burner system attached to the chassis, a fuel delivery system coupled to the burner system, and an elevation system having leg assemblies connected to the chassis, the elevation system having at least three of the leg assemblies;

wherein the leg assemblies include an upper leg, a lower leg, and a locking mechanism, the upper leg having a proximate end pivotally attached to the chassis and a distal end pivotally attached to the lower leg, the lacking mechanism configured to lock the lower leg into the upper leg when the lower leg and the upper leg are in a deployed position; and wherein the leg assemblies may fold into the chassis for storage when the collapsible portable stove is in a collapsed configuration and the leg assemblies may unfold to elevate the collapsible portable stove in an expanded configuration.

2. The stove according to claim 1, further comprising a shelf assembly, wherein the shelf assembly removably attaches to an underside of the chassis for storage, to a topside of the chassis for table space, and to the leg assemblies for shelf space beneath the chassis and between the leg assemblies.

3. The stove according to claim 1, further comprising a windscreen assembly removably attached to the chassis and arranged around the burner system.

4. The stove according to claim 1, further comprising a hoist assembly having a pole and a winch attached to a top of the pole, the winch including a winch wire, and the winch being operable to lower and raise an end of the winch wire toward and away from the burner assembly, and wherein a base of the pole is held removably within a pole holder attached to the chassis.

5. The stove according to claim 1, further comprising a side table assembly slidably attached to a topside of the chassis, wherein the side table assembly slides outward along a pair of slides to reveal the burner system.

6. The stove according to claim 1, wherein the upper leg of each of the leg assemblies comprises a support at a distal end, and wherein the leg assemblies elevate the collapsible portable stove to a low-profile configuration when the upper legs are unfolded and the lower legs are folded, the stove resting on the supports for the upper legs in the low-profile configuration, and wherein the leg assemblies elevate the collapsible portable stove to a high-profile configuration when the upper legs are unfolded and the lower legs are unfolded.

7. The stove according to claim 1, wherein, for each leg assembly, the lower leg is pivotably connected in a earn slide slot and each leg assembly comprising a spring, the spring locks the lower leg in place against the upper leg in the folded position by exerting force on the lower leg so as to cause a detent groove on one of the lower leg and the upper leg to engage a detent bar on the other of the lower leg and the upper leg.

8. The stove according to claim 1, wherein, for each leg assembly, the lower leg is pivotally connected in a cam slide slot, and the locking mechanism for each leg assembly comprising a spring, the spring biasing the lower leg in the deployed position along the cam slide slot so as to cause a tooth on one of the lower leg and the upper leg to engage a tooth groove on the other of the upper leg and the lower leg.

9. The stove according to claim 8, wherein the spring locks the lower leg in place against the upper leg in the folded position by exerting force on the lower leg so as to cause a detent groove on the lower leg to engage a detent bar on the upper leg.

10. The stove according to claim 1, further comprising a leg holder on the chassis, one of the upper leg and the leg holder comprising a tooth, and the other comprising a tooth detent, the upper leg being pivotally attached to the leg holder along a cam slide slot, and wherein the tooth is situated and configured to engage and lock into the tooth detent when the leg assembly is a deployed position.

11. The stove according to claim 1, wherein the burner system includes a high power sub-burner and a low power sub-burner that nests inside the high power sub-burner to form a burner-in-burner system, wherein the low power sub-burner includes internal baffles configured and positioned to divide an annular gas chamber for the low power sub-burner between an lower annular gas chamber and an upper annular gas chamber so as to more evenly distribute fuel circumferentially around an annular gas chamber for the low power sub-burner before the fuel exits out burner holes for the low power sub-burner.

12. The stove according to claim 11, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

13. The stove according to claim 1, wherein the burner system includes a high power sub-burner and a low power sub-burner that nests inside the high power sub-burner to form a burner-in-burner system, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

14. A collapsible portable stove comprising:

a chassis, a burner system attached to the chassis, a fuel delivery system coupled to the burner system, and a hoist assembly having a pole and a winch attached to a top of the pole, the winch including a winch wire, and the winch being operable to lower and raise an end of the winch wire toward and away from the burner assembly, and wherein a base of the pole is held removably within a pole holder attached to the chassis.

15. The stove according to claim 14, further comprising an elevation system having leg assemblies connected to the chassis, the elevation system having at least three of the leg assemblies;

wherein the leg assemblies include an upper leg and a lower leg, the upper leg having a proximate end pivotally attached to the chassis and a distal end pivotally attached to the lower leg;

wherein the leg assemblies may fold into the chassis for storage when the collapsible portable stove is in a collapsed configuration, and the leg assemblies may unfold to elevate the collapsible portable stove in an expanded configuration; and wherein the leg assemblies elevate the collapsible portable stove to a low-profile configuration when the upper legs are unfolded and the lower legs are folded, and wherein the leg assemblies elevate the collapsible portable stove to a high-profile configuration when the upper legs are unfolded and the lower legs are unfolded.

16. The stove according to claim 14, further comprising a shelf assembly, wherein the shelf assembly removably attaches to an underside of the chassis for storage, to a topside of the chassis for table space, and to the leg assemblies for shelf space beneath the chassis and between the leg assemblies.

17. The stove according to claim 14, further comprising a windscreen assembly removably attached to the chassis and arranged around the burner system.

18. The stove according to claim 14, further comprising a side table assembly slidably attached to a topside of the chassis, wherein the side table assembly slides outward along a pair of slides to reveal the burner system.

19. The stove according to claim 15, wherein the upper leg of each of the leg assemblies comprises a support at a distal end, and wherein the leg assemblies elevate the collapsible portable stove to a low-profile configuration when the upper legs are unfolded and the lower legs are folded, the stove resting on the supports for the upper legs in the low-profile configuration, and wherein the leg assemblies elevate the collapsible portable stove to a high-profile configuration when the upper legs are unfolded and the lower legs are unfolded.

20. The stove according to claim 14, wherein the burner system includes a high power sub-burner and a low power sub-burner that nests inside the high power sub-burner to form a burner-in-burner system, wherein the low power sub-burner includes internal baffles configured and positioned to divide an annular gas chamber for the low power sub-burner between an lower annular gas chamber and an upper annular gas chamber so as to more evenly distribute fuel circumferentially around an annular gas chamber for the low power sub-burner before the fuel exits out burner holes for the low power sub-burner.

21. The stove according to claim 20, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

22. The stove according to claim 20, wherein the burner system includes a high power sub-burner and a low power sub-burner that nests inside the high power sub-burner to form a burner-in-burner system, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

23. A collapsible portable stove comprising:

a chassis, a burner system attached to the chassis, a fuel delivery system coupled to the burner system, an elevation system having leg assemblies connected to the chassis, the elevation system having at least three of the leg assemblies;

wherein the leg assemblies include an upper leg and a lower leg, the upper leg having a proximate end pivotally attached to the chassis and a distal end pivotally attached to the lower leg;

wherein the leg assemblies may fold into the chassis for storage when the collapsible portable stove is in a collapsed configuration, and the leg assemblies may unfold to elevate the collapsible portable stove in an expanded configuration, and a leg holder on the chassis, one of the upper leg for a leg assembly and the leg holder comprising a tooth, and the other comprising a tooth detent the upper leg being pivotally attached to the leg holder along a cam slide slot, and wherein the tooth is situated and configured to engage and lock into the tooth detent when the leg assembly is a deployed position.

24. The stove according to claim 23, wherein the leg assemblies elevate the collapsible portable stove to a low-profile configuration when the upper legs are unfolded and the lower legs are folded, and wherein the leg assemblies elevate the collapsible portable stove to a high-profile configuration when the upper legs are unfolded and the lower legs are unfolded.

25. The stove according to claim 23, further comprising a shelf assembly, wherein the shelf assembly removably attaches to an underside of the chassis for storage, to a topside of the chassis for table space, and to the leg assemblies for shelf space beneath the chassis and between the leg assemblies.

26. The stove according to claim 23, further comprising a windscreen assembly removably attached to the chassis and arranged around the burner system.

27. The stove according to claim 23, wherein the upper leg of each of the leg assemblies comprises a support at a distal end, and wherein the leg assemblies elevate the collapsible portable stove to a low-profile configuration when the upper legs are unfolded and the lower legs are folded, the stove testing on the supports for the upper legs in the low-profile configuration, and wherein the leg assemblies elevate the collapsible portable stove to a high-profile configuration when the upper legs are unfolded and the lower legs are unfolded.

28. The stove according to claim 23, wherein the burner system includes a high power sub-burner and a low power sub-burner that nests inside the high power sub-burner to form a burner-in-burner system, wherein the low power sub-burner includes internal baffles configured and positioned to divide an annular gas chamber for the low power sub-burner between an lower annular gas chamber and an upper annular gas chamber so as to more evenly distribute fuel circumferentially around an annular gas chamber for the low power sub-burner before the fuel exits out burner boles for the low power sub-burner.

29. The stove according to claim 28, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

30. The stove according to claim 28, wherein the burner system includes a high power sub-burner and a low power sub-burner that nests inside the high power sub-burner to form a burner-in-burner system, wherein the high power sub-burner includes internal baffles configured and positioned to divide an annular gas chamber for the high power sub-burner between an lower annular gas chamber and an upper annular gas chamber so as to more evenly distribute fuel circumferentially around an annular gas chamber for the high power sub-burner before the fuel exits out burner holes for the high power sub-burner.

31. A collapsible portable stove comprising:

a chassis, a burner system attached to the chassis, and a fuel delivery system coupled to the burner system, wherein the burner system includes a high power sub-burner and a low power sub-burner that nests inside the high power sub-burner to form a burner-in-burner system, wherein one of the low power sub-burner and the high power sub-burner includes internal baffles configured and positioned to divide an annular gas chamber for the one between an lower annular gas chamber and an upper annular gas chamber so as to more evenly distribute fuel circumferentially around an annular gas chamber for the one before the fuel exits out burner holes for the one.

32. The stove according to claim 31, wherein the other of the low power sub-burner and the high power sub-burner includes internal baffles configured and positioned to divide an annular gas chamber for the other between an lower annular gas chamber and an upper annular gas chamber so as to more evenly distribute fuel circumferentially around an annular gas chamber for the other before the fuel exits out burner holes for the other.

33. The stove according to claim 31, wherein internal baffles comprise a perforated plenum between an lower annular gas chamber and an upper annular gas chamber.

34. The stove according to claim 31, further comprising an elevation system having leg assemblies connected to the chassis, the elevation system having at least three of the leg assemblies;

wherein the leg assemblies include an upper leg and a lower leg, the upper leg having a proximate end pivotally attached to the chassis and a distal end pivotally attached to the lower leg;

wherein the leg assemblies may fold into the chassis for storage when the collapsible portable stove is in a collapsed configuration, and the leg assemblies may unfold to elevate the collapsible portable stove in an expanded configuration; and wherein the leg assemblies elevate the collapsible portable stove to a low-profile configuration when the upper legs are unfolded and the lower legs are folded, and wherein the leg assemblies elevate the collapsible portable stove to a high-profile configuration when the upper legs are unfolded and the lower legs are unfolded.

35. The stove according to claim 31, further comprising a shelf assembly, wherein the shelf assembly removably attaches to an underside of the chassis for storage, to a topside of the chassis for table space, and to the leg assemblies for shelf space beneath the chassis and between the leg assemblies.

36. The stove according to claim 31, further comprising a windscreen assembly removably attached to the chassis and arranged around the burner system.

37. The stove according to claim 34, wherein the upper leg of each of the leg assemblies comprises a support at a distal end, and wherein the leg assemblies elevate the collapsible portable stove to a low-profile configuration when the upper legs are unfolded and the lower legs are folded, the stove resting on the supports for the upper legs in the low-profile configuration, and wherein the leg assemblies elevate the collapsible portable stove to a high-profile configuration when the upper legs are unfolded and the lower legs are unfolded.

* * * * *